US006135926A

United States Patent [19]

Lee

[11] Patent Number: 6,135,926

[45] Date of Patent: Oct. 24, 2000

[54] STRIDING EXERCISER

[76] Inventor: Gin Wen Lee, P.O. Box 63-99, Taichung, Taiwan

[21] Appl. No.: 08/863,251

[22] Filed: May 27, 1997

[51] Int. Cl.[7] ..... A63B 69/16; A63B 22/04

[52] U.S. Cl. ..... 482/57; 482/51; 482/70

[58] Field of Search ..... 482/51, 52, 53, 482/57, 70, 62, 71, 79, 80

[56] References Cited

U.S. PATENT DOCUMENTS

| | | | |
|---|---|---|---|
| 5,290,211 | 3/1994 | Stearns | 482/70 |
| 5,336,141 | 8/1994 | Vittone | 482/70 |
| 5,518,473 | 5/1996 | Miller | 482/57 |
| 5,577,985 | 11/1996 | Miller | 482/52 |

FOREIGN PATENT DOCUMENTS 2919494 11/1980 Germany .

*Primary Examiner*—Stephen R. Crow

[57] ABSTRACT

A striding exerciser includes two foot supports movably supported in a base and two foot pedals slidably engaged on the foot supports. The base has two posts for pivotally supporting the front and the rear portions of the foot supports. A pair of link members pivotally couple the foot pedals to the rear portion of the base for allowing the link members to move the foot pedals along the foot supports when the foot supports move forward and rearward. A pair of handles are pivotally coupled to the foot supports for allowing the handles to be rotated by the foot supports.

4 Claims, 3 Drawing Sheets

STRIDING EXERCISER

BACKGROUND OF THE INVENTION

1. Field of the Invention

The present invention relates to an exerciser, and more particularly to a striding exerciser.

2. Description of the Prior Art

Typical striding exercisers comprise a pair of foot supports pivotally coupled to a bracket. The foot supports each includes a foot pedal secured to the bottom for supporting the user. However, the foot pedals may not be moved relative to the foot supports.

The present invention has arisen to mitigate and/or obviate the afore-described disadvantages of the conventional striding exercisers.

SUMMARY OF THE INVENTION

The primary objective of the present invention is to provide a striding exerciser which includes a pair of foot pedals that may be slided relative to the foot supports.

In accordance with one aspect of the invention, there is provided a striding exerciser comprising a base, a pair of foot supports supported in the base, a pair of foot pedals slidably engaged on the foot supports, and means for moving the foot pedals along the foot supports.

The base includes a front post, the foot supports each includes a front portion pivotally coupled to the front post.

The base includes a rear post and includes a shaft provided on the front post, a first lever rotatably secured to the shaft and extended downward and having a lower end, and a second lever rotatably secured to the shaft and extended upward and having an upper end, the front portions of the foot supports are pivotally coupled to the lower end of the first lever and to the upper end of the second lever respectively, the foot supports each includes a rear portion pivotally coupled to the rear post for allowing the foot supports to be moved forward and rearward.

The foot pedals moving means include a pair of sticks pivotally coupling the foot pedals to the base for allowing the foot pedals to be moved along the foot supports when the foot supports move forward and rearward.

A pair of beams include an upper portion pivotally coupled to the rear post, the beams each includes a lower end and a middle portion, the rear portions of the foot supports are pivotally coupled to the middle portions of the beams, and a pair of sticks pivotally couple the foot pedals to the lower ends of the beams for allowing the foot pedals to be moved along the foot supports when the foot supports move forward and rearward.

A pair of handles are pivotally coupled to the front post, and a pair of links couple the handles to the foot supports for allowing the handles to be rotated by the foot supports.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
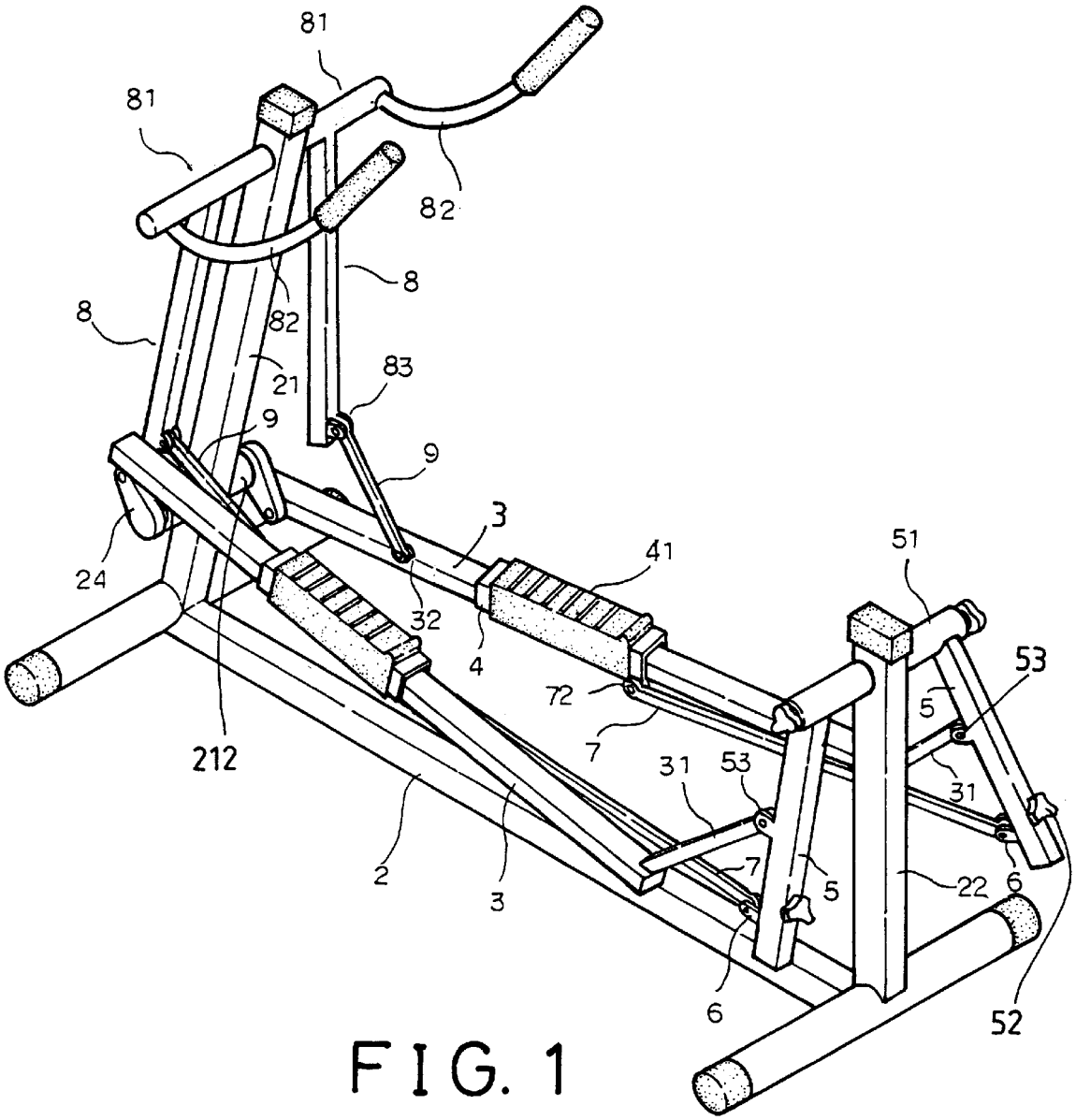
FIG. 1 is a perspective view of a striding exerciser in accordance with the present invention.
Figure 2:
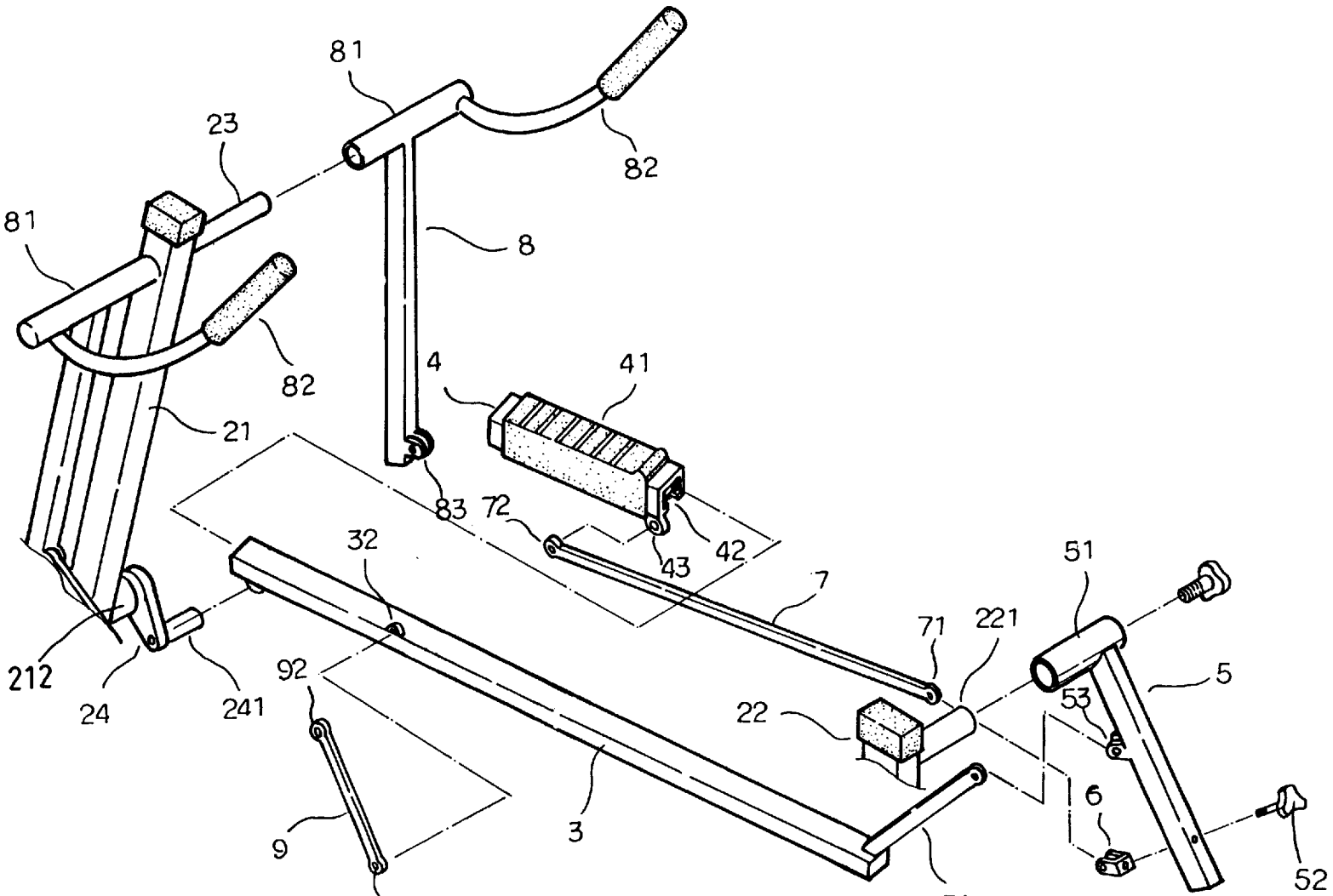
FIG. 2 is an exploded view of the striding exerciser.

Referring to the drawings, and initially to FIGS. 1 and 2, a striding exerciser in accordance with the present invention comprises a base 2 including a front post 21 and a rear post 22 extended upward. The posts 21, 22 each includes a rod 23, 221 provided on top (FIG. 2). A pair of arms 8 each includes a sleeve 81 rotatably engaged on the rod 23 and a handle 82 extended from the sleeve 81. A pair of beams 5 each includes a sleeve 51 rotatably engaged on the rod 221 and each includes a coupler 6 secured to the lower portion by a fastener 52. The front post 21 includes a shaft 212 provided on the lower portion.

A pair of levers 24 are secured to the shaft 212 and rotatable about the shaft 212. One of the levers 24 extends downward and the other lever 24 extends upward. A pair of foot supports 3 each includes a front end pivotally coupled to the levers 24 at a pivot axle 241 (FIG. 2) for allowing the front ends of the foot supports 3 to be rotatable about the shaft 212. The foot supports 3 each includes an extension 31 extended upward for pivotally coupling to the middle portion 53 of the beam 5 for allowing the foot supports 3 to be moved forward and rearward in a reciprocating action. A pair of links 9 each has a lower end 91 pivotally coupled to the middle portion 32 of the foot support 3 and each has an upper end 92 pivotally coupled to the lower end 83 of the arm 8 for allowing the handles 82 to be rotated by the foot supports 3.

A pair of foot pedals 4 are slidably engaged on the foot supports 3 and each includes an outer cover 41 and each includes one or more rollers 42 (FIGS. 2, 3) for engaging with the foot support 3 and for allowing the foot pedals 4 to be smoothly slided along the foot supports 3. A pair of sticks 7 each includes a rear end 71 pivotally coupled to the coupler 6 of the beam 5 and each includes a front end 72 pivotally coupled to the rear bottom portion 43 of the foot pedal 4.

Figure 3:
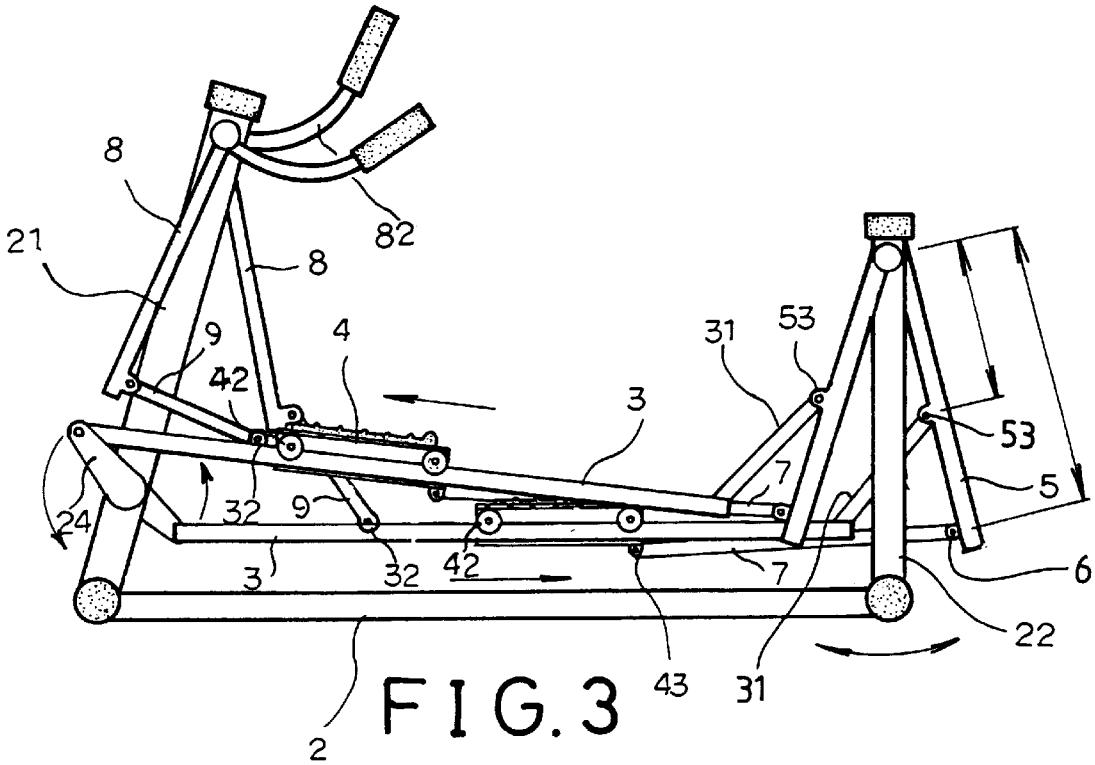
FIG. 3 is a side view of the striding exerciser.

In operation, as shown in FIG. 3, the swinging amplitudes of the middle portion 53 of the beam 5 and the coupler 6 are different such that the foot pedals 4 may be moved along the foot supports 3 by the sticks 7 while the foot supports 3 are moved forward and rearward in a reciprocating action.

Figure 4:
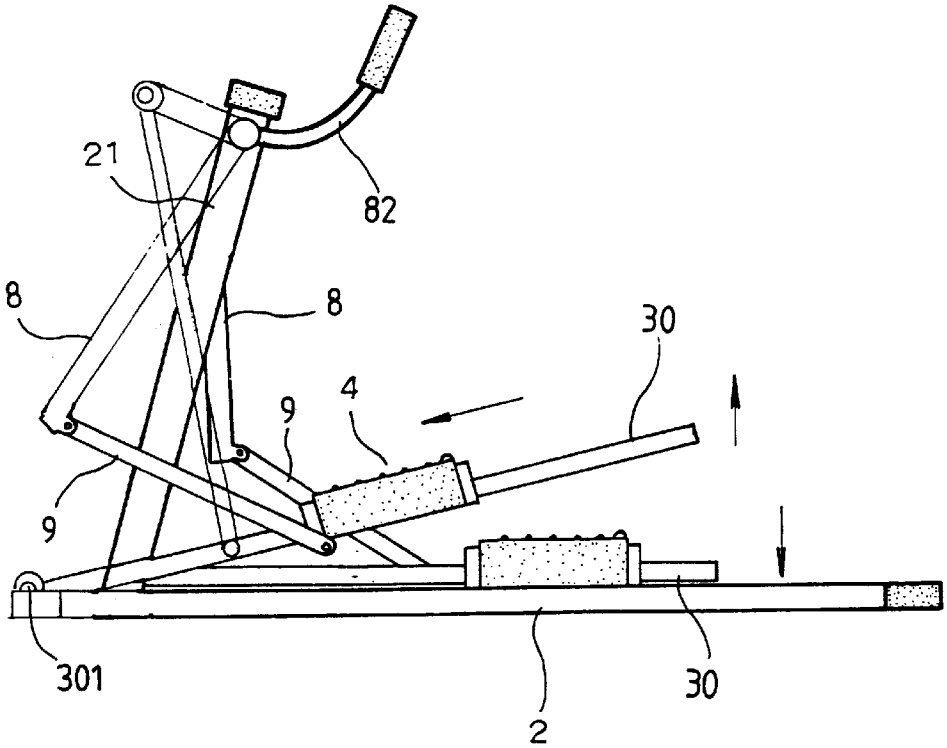
FIG. 4 is a side view illustrating the other application of the striding exerciser.

Referring next to FIG. 4, the foot supports 30 may include a front portion pivotally coupled to the base 2 at a pivot pin 301 and the links 9 may pivotally couple the foot pedals 4 to the arms 8 for allowing the links 9 to move the foot pedals 4 along the foot supports 30.

Accordingly, the striding exerciser in accordance with the present invention includes a pair of foot pedals that may be slided relative to the foot supports for allowing the user to conduct different striding exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A striding exerciser comprising:

a base including a front post, a pair of foot supports supported in said base, a pair of foot pedals slidably engaged on said foot supports and each including a front portion pivotally coupled to said front post, and means for moving said foot pedals along said foot supports, said base including a rear post and including a shaft provided on said front post, a first lever rotatably secured to said shaft and extended downward and having a lower end, and a second lever rotatably secured to said shaft and extended upward and having an upper end, said front portions of said foot supports being pivotally coupled to said lower end of said first lever and to said upper end of said second lever respectively, said foot supports each including a rear portion pivotally coupled to said rear post for allowing said foot supports to be moved forward and rearward.

2. A striding exerciser according to claim 1, wherein said foot pedals moving means include a pair of sticks pivotally coupling said foot pedals to said base for allowing said foot pedals to be moved along said foot supports when said foot supports move forward and rearward.

3. A striding exerciser according to claim 1 further comprising a pair of beams including an upper portion pivotally coupled to said rear post, said beams each including a lower end and a middle portion, said rear portions of said foot supports being pivotally coupled to said middle portions of said beams, and a pair of sticks pivotally coupling said foot pedals to said lower ends of said beams for allowing said foot pedals to be moved along said foot supports when said foot supports move forward and rearward.

4. A striding exerciser according to claim 1 further comprising a pair of handles pivotally coupled to said front post, and means coupling said handles to said foot supports for allowing said handles to be rotated by said foot supports.

* * * * *